United States Patent [19]

Ricken

[11] Patent Number: 4,782,822

[45] Date of Patent: Nov. 8, 1988

[54] RESONANCE FREQUENCY STIMULATOR

[76] Inventor: James F. Ricken, Box 3832 H.S., Ruidoso, N. Mex. 88345

[21] Appl. No.: 82,589

[22] Filed: Aug. 7, 1987

[51] Int. Cl.[4] ..... A61H 1/00

[52] U.S. Cl. ..... 128/33; 119/28

[58] Field of Search ..... 128/32, 33, 24 R, 64, 128/34–37, 44–55, 67; 119/28, 29

[56] References Cited

U.S. PATENT DOCUMENTS

| | | | |
|---|---|---|---|
| 2,934,062 | 4/1960 | Klassen et al. | 128/33 |
| 2,935,064 | 5/1960 | Moxley | 128/33 |
| 3,279,461 | 10/1966 | Oliver | 128/33 |
| 3,411,497 | 11/1968 | Rickey et al. | 128/33 |

FOREIGN PATENT DOCUMENTS

| | | | |
|---|---|---|---|
| 185865 | 6/1907 | Fed. Rep. of Germany | 128/33 |
| 65831 | 3/1969 | German Democratic Rep. | 128/33 |

*Primary Examiner*—J. Reed Fisher

*Assistant Examiner*—Moshe I. Cohen

*Attorney, Agent, or Firm*—Charles C. Logan

[57] ABSTRACT

A resonance frequency stimulator for increasing blood circulation by having a four-legged animal or person standing upon a top plate through which vibrations are transmitted. The top plate is oriented substantially in a horizontal plane and it rests resiliently on a plurality of coiled compression springs at a predetermined height above a bottom plate. Fastening structure passes through the coiled compression springs to secure the top plate to the bottom plate. A rotary vibrator with motor is mounted on the top plate adjacent the front end of the top plate for producing a resonance frequency vibration in the top plate. A frame assembly surrounds the front end, the rear end and the lateral sides of the bottom plate. A handrail assembly extends upwardly a predetermined height from the frame assembly along both lateral sides thereof and also transversely thereto at a position rearwardly of the motor.

6 Claims, 2 Drawing Sheets

RESONANCE FREQUENCY STIMULATOR

BACKGROUND OF THE INVENTION

The invention relates to a resonance frequency stimulator and more specifically to a device for increasing blood circulation in four-legged animals.

Presently many animals such as horses have poor circulation due to their being confined in stalls and small areas most of the time. When these animals are injured the poor circulation delays and extends the period of time for their recovery. Animals and humans are aided in their recovery from injuries by the blood that circulates through their bodies. When their circulation is poor it takes a much longer time for the injured area to heal itself.

It is an object of the invention to provide a novel resonance frequency stimulator that can be used for increasing blood circulation on four-legged animals such as horses.

It is also an object of the invention to provide a novel resonance frequency stimulator for increasing blood circulation that performs its function while the animal is standing thereon.

It is another object of the invention to provide a novel resonance frequency stimulator for increasing blood circulation in animals that is portable.

It is a further object of the invention to provide a novel resonance frequency stimulator for increasing blood circulation in animals that is economical to manufacture and market.

SUMMARY OF THE INVENTION

Applicant's novel resonance frequency stimulator has been designed so that an animal can stand on its top plate and receive vibrations through its body which will promote and increase blood circulation. The motor is connected to a rotary type of vibrator and it produces a minimum amplitude and has variable speed frequencies. Its sinusoidal wave of energy has a tuning capability that is completely different from that of the shock interrupted wave produced by linear vibrators. The motor with rotary vibrator has the capability to resonate thereby reaching the feet, legs, and the upper body of the animal. This increases circulation throughout the body of the animal. The size and the fact that the unit is made of light weight material makes it very portable. Also since the unit is substantially made from aluminum components there is very little maintenance.

The unit can be used with vibrostatic leg and body material such as leg wraps and blankets. They produce a negative charge of static electricity from friction with the hair. This unit could also be incorporated with a portable whirlpool or it could be made with a tongue for pulling it and mounting the unit on wheels. The unit does not conflict with other methods of therapy.

DESCRIPTION OF THE PREFERRED EMBODIMENT

Figure 1:
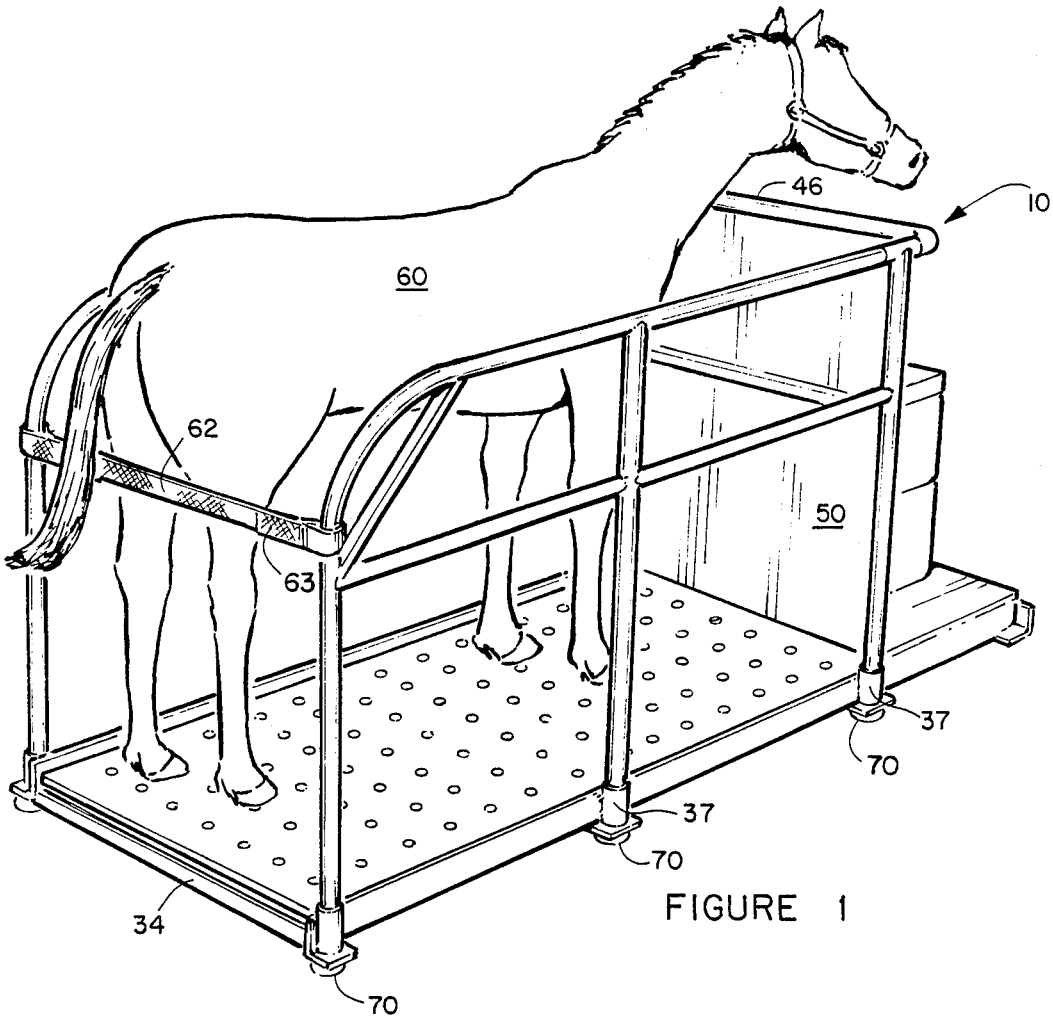
FIG. 1 is a front perspective view of applicant's novel resonance frequency stimulator.
Figure 2:
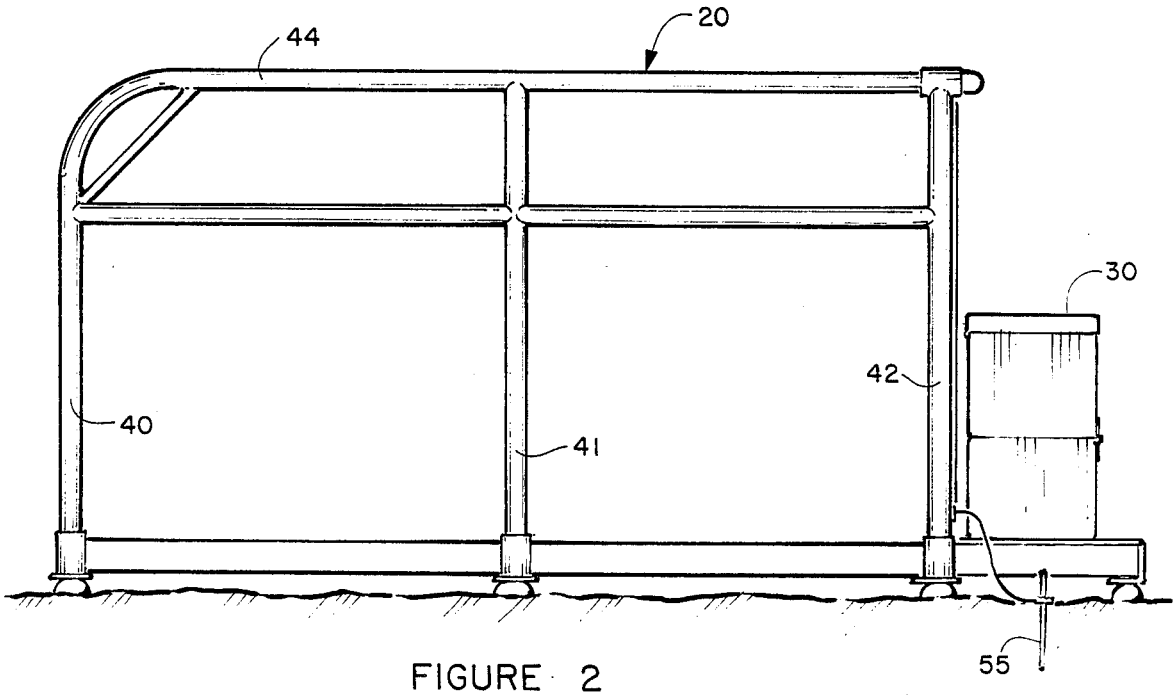
FIG. 2 is a side elevation view of the novel resonance frequency stimulator.
Figure 3:
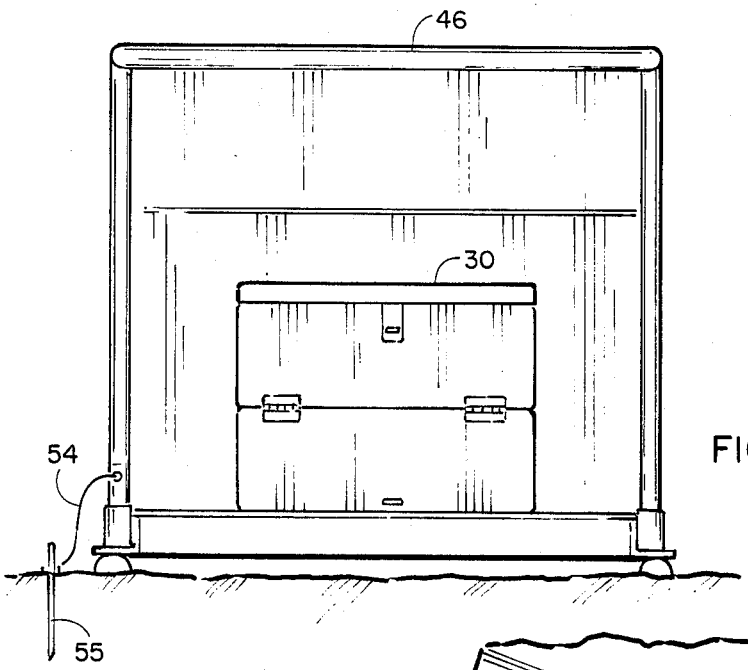
FIG. 3 is a front elevation view of the novel resonance frequency stimulator.
Figure 4:
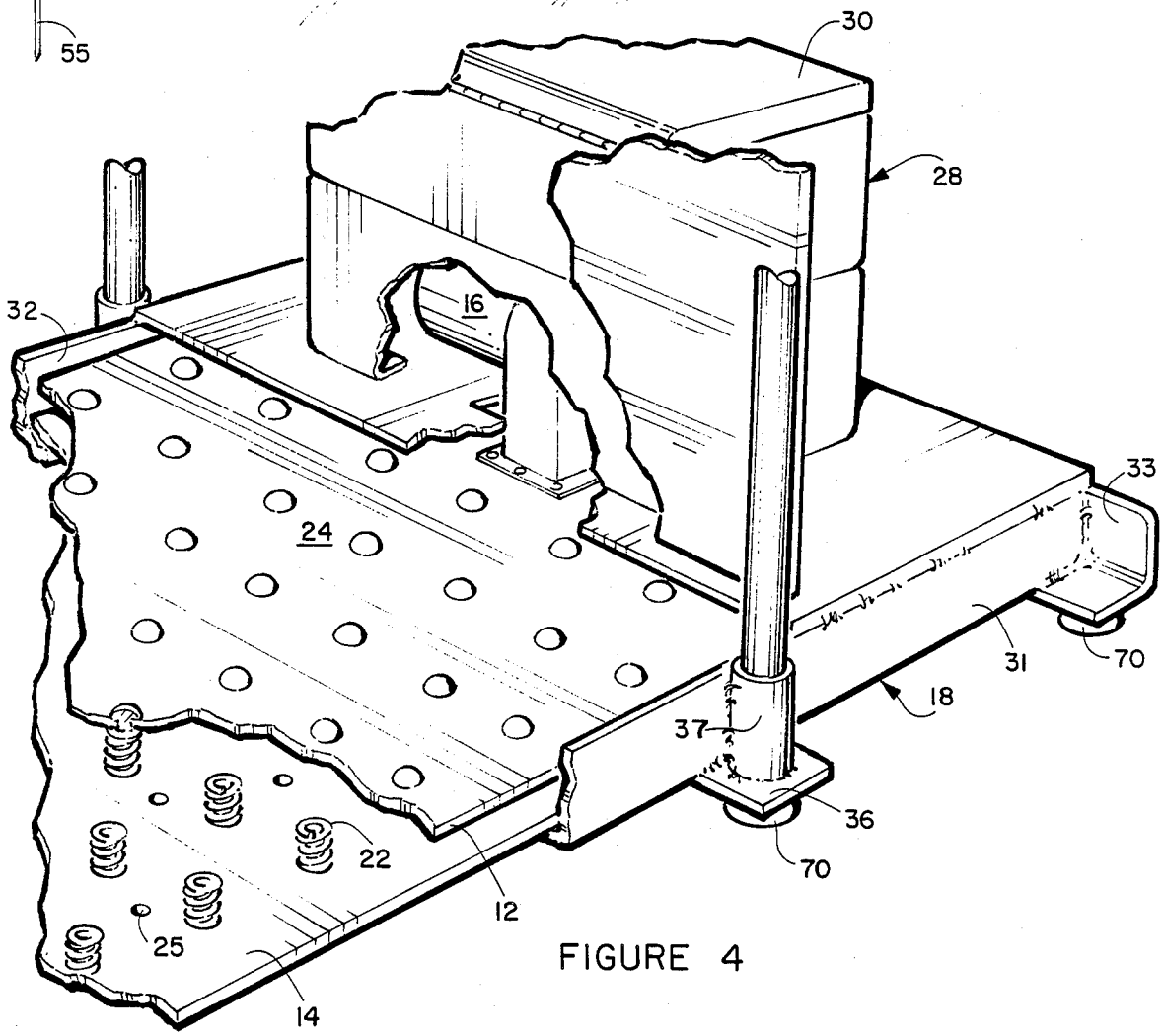
FIG. 4 is a partial perspective view illustrating portions of the resonance frequency stimulator broken away for increased clarity.

Applicant's novel resonance frequency stimulator will now be described by referring to FIGS. 1–4 of the drawings. The resonance frequency stimulator is generally designated numeral 10. It has a top plate 12, a bottom plate 14, a rotary vibrator with motor 16, a frame assembly 18, and a handrail assembly 20.

Bottom plate 14 has a predetermined width and a predetermined length and it is oriented in a substantially horizontal plane. A predetermined number of coiled compression springs 22 are mounted on the top surface of bottom plate 14 with axes directed substantially vertically. Top plate 12 has a predetermined width and a predetermined length and it is also oriented in a substantially horizontal plane. Its bottom surface rests resiliently on the coiled compression springs 22 at a predetermined height above bottom plate 14. A rubber mat 24 is attached by pop rivets to top plate 12. A plurality of drain holes 25 are formed in bottom plate 14.

A rotary vibrator with motor 16 is mounted on the top surface of top plate 12 inside a housing 28. The housing 28 has a top cover 30 that is hinged at its top edge and when opened the controls for changing the amplitude and frequency of the motor are visable.

Frame assembly 18 is formed from a pair of angle iron shaped side frame members 31 and 32, front end frame member 33, and rear end frame member 34. Bottom plate 14 can be secured to the frame assembly by any suitable means, one of which would be by welding it thereto. A plurality of brackets 36 are welded to the side frame members and each bracket has a tubular sleeve 37 secured thereto. Tubular pipe rail members 40, 41 and 42 are mounted in the respective tubular sleeves 37. A top handrail 44 extends along the top of the tubular pipe members and a front safety rail 46 connects the front end of the side rail assemblies 20. A front plate 50 is secured to the front tubular pipes 42 to protect the housing 28 from damage by the animal. A ground wire 54 is connected to a ground stake 55. An animal such as a horse 60 would be captured within the side rail assembly by a safety belt 62 having quick detachable portions 63 that are formed of Velcro material.

The top plate, bottom plate, frame assembly, side rail assembly, and housing are all formed of light weight aluminum material to make the unit portable. A plurality of rubber bushings 70 are mounted on the underside of the respective brackets 36.

What is claimed is:

1. A resonance frequency stimulator for increasing blood circulation in horses comprising:

an elongated bottom plate having a width greater than that of a horse and a length greater than that of a horse and being oriented in a substantially horizontal plane, said bottom plate having a top surface having a predetermined number of coiled compression springs positioned thereon with their axes directed substantially vertically;

an elongated top plate having a width substantially the same as that of said bottom plate and a length substantially the same as that of said bottom plate and being oriented in a substantially horizontal plane, said top plate having a bottom surface that rests resiliently on said coiled compression springs at a predetermined height above said bottom plate;

fastening means that pass through said coiled compression springs and secure said top plate to said bottom plate;

a frame assembly having a length greater than the length of said top plate and a width greater than that of said top plate, said frame having a substantially vertical front wall, rear wall and laterally spaced side walls so that said top plate has unrestricted upward and downward motion on said coiled compression springs, said bottom plate being fixedly secured to said frame assembly;

a hand rail assembly extending upwardly at least to the chest height of a horse from said frame assembly, said hand rail assembly extending along both lateral sides of said frame assembly, said lateral sides each having a vertically oriented front tubular pipe member and a vertically oriented rear tubular pipe member, said front tubular pipe members being located rearwardly from the front end of said frame assembly a distance approximating the length of a horse's head, a front safety rail extends laterally between the top ends of said front tubular pipe members so that a horse's head can extend over it, a vertically oriented front plate extends between said front tubular pipe members to prevent a horse from kicking structure mounted forwardly of said tubular pipe members; and a rotary vibrator with motor is mounted on said top plate for producing a resonance frequency vibration in said top plate, said motor being mounted forwardly of said tubular pipe members adjacent the front end of said top plate.

2. A resonance frequency stimulator as recited in claim 1 further comprising a predetermined number of drain holes formed in said bottom plate.

3. A resonance frequency stimulator as recited in claim 1 further comprising a rubber mat attached to the top surface of said top plate.

4. A resonance frequency stimulator as recited in claim 1 wherein said top plate, said bottom plate, said frame assembly and said hand rail assembly are made of aluminum.

5. A resonance frequency stimulator as recited in claim 1 further comprising rubber bushings mounted on the bottom of said frame assembly.

6. A resonance frequency stimulator as recited in claim 1 further comprising a safety belt detachably secured across the rear end of said hand assembly.

* * * * *